US010267056B1

(12) United States Patent
Eastland

(10) Patent No.: US 10,267,056 B1
(45) Date of Patent: Apr. 23, 2019

(54) TENT WITH ENHANCED LOAD-BEARING CAPACITY

(71) Applicant: Erik Lee Eastland, Torrance, CA (US)

(72) Inventor: Erik Lee Eastland, Torrance, CA (US)

( * ) Notice: Subject to any disclaimer, the term of this patent is extended or adjusted under 35 U.S.C. 154(b) by 0 days.

(21) Appl. No.: 15/799,877

(22) Filed: Oct. 31, 2017

Related U.S. Application Data

(60) Provisional application No. 62/415,992, filed on Nov. 1, 2016.

(51) Int. Cl.
*E04H 15/48* (2006.01)
*E04B 1/343* (2006.01)
*E04H 15/54* (2006.01)

(52) U.S. Cl.
CPC ..... *E04H 15/48* (2013.01); *E04B 1/34384* (2013.01); *E04H 15/54* (2013.01)

(58) Field of Classification Search
CPC ..... E04H 15/48; E04H 15/52; E04H 15/34; E04H 15/18; E04H 15/32; E04H 1/34384; E04B 1/34384
USPC ..... 135/117, 122, 157, 160, 121, 87
See application file for complete search history.

(56) References Cited

U.S. PATENT DOCUMENTS 785,571 A * 3/1905 Raines et al. ..... E04H 15/48 135/142
2,745,420 A * 5/1956 Zitomer ..... E06B 9/52 135/117
2,857,027 A * 10/1958 Lindman ..... E04C 3/32 52/311.3
3,323,530 A * 6/1967 Smith ..... A01M 31/00 135/115
3,424,178 A * 1/1969 Yazaki ..... A01G 9/16 135/157
3,744,195 A * 7/1973 Ferkich ..... E04B 1/34315 135/117
4,941,500 A 7/1990 Emard
5,758,196 A * 5/1998 Laing ..... G03B 15/06 135/124
5,813,160 A * 9/1998 Thoelke ..... A01M 31/025 135/121
5,915,132 A * 6/1999 Counts, Jr. ..... G03B 15/10 396/1
6,820,629 B2 * 11/2004 Tseng ..... E04H 15/60 108/179
6,923,195 B2 * 8/2005 Tseng ..... E04C 3/32 135/122
6,964,321 B2 * 11/2005 Baughman, III ..... E04H 15/18 135/87

(Continued)

*Primary Examiner* — Noah Chandler Hawk
(74) *Attorney, Agent, or Firm* — Plager Schack LLP

(57) ABSTRACT

A tent with an enhanced load-bearing capacity secures accessories and equipment. The tent includes an upper panel assembly having a front panel, a rear panel and a pair of side panels connecting the front and rear panels together, the front, rear and side panels forming a roof with an upper sloping surface, and a plurality of support legs coupled to the upper panel assembly, each support leg having an upper end coupled to the upper panel assembly and a lower end in contact with the ground surface, each support leg designed to slidably adjust to permit height adjustments of the roof above the ground surface. Each support leg and each panel in the upper panel assembly are designed to permit the attachment of one or more accessories or equipment thereon.

7 Claims, 4 Drawing Sheets

(56) References Cited

U.S. PATENT DOCUMENTS

| | | | |
|---|---|---|---|
| 9,556,639 | B2 | 1/2017 | Hunt |
| 2005/0016573 | A1 | 1/2005 | Wu |

* cited by examiner

TENT WITH ENHANCED LOAD-BEARING CAPACITY

RELATED APPLICATION

The application claims priority to provisional patent application U.S. Ser. No. 62/415,992 filed on Nov. 1, 2016, the entire contents of which is herein incorporated by reference.

BACKGROUND

The embodiments herein relate generally to portable tent structures for use in the event industry. More specifically, embodiments of the invention are directed to a tent with an enhanced load-bearing capacity.

Portable tents are often assembled for use as hospitality suites in the sports, entertainment, or advertising industries. In these industries, time is of the essence, as tight production schedules must be followed, and users are limited to the amount of decoration and accessories they can display due to time and labor constraints, thereby limiting their ability to sell the consumer their products or services.

Current portable and tool-less tent and roof structures including those disclosed in U.S. Patent Application Publication 2005/0016573, U.S. Pat. Nos. 4,941,500 and 9,556,639, are limited because they cannot bear heavy loads across their horizontal spans and/or vertical legs, which is necessary for the event industry when lights, video screens, speakers, other sound accessories, and other forms of equipment are desired to be mounted for advertising and hospitality purposes. As a result, individuals have to use additional stands, trussing, and other structures to mount their heavy video, lighting, sound accessories and other equipment, thereby making an event setup extremely labor intensive and inefficient.

As such, there is a need in the industry for a portable tent with an enhanced load-bearing capacity that addresses the limitations of the prior art, which permits users to quickly assemble the structure without tools and secure equipment or accessories directly to the tent's frame.

SUMMARY

A tent with an enhanced load-bearing capacity for use on a ground surface is provided. The tent is configured to reduce assembly time and secure a plurality of accessories and equipment thereon. The tent comprises an upper panel assembly comprising a front panel, a rear panel and a pair of side panels connecting the front and rear panels together, the front, rear and side panels forming a roof with an upper sloping surface from the front panel to the rear panel, and a plurality of support legs coupled to the upper panel assembly, each support leg in the plurality of support legs comprising an upper end coupled to the upper panel assembly and a lower end in contact with the ground surface, each support leg in the plurality of support legs configured to slidably adjust to vary a length of the support leg to permit height adjustments of the roof above the ground surface, wherein each support leg in the plurality of support legs and each panel in the upper panel assembly are configured to permit the attachment of one or more accessories or equipment thereon.

In certain embodiments of the invention, each panel in the front and rear panels comprises a generally rectangular-shaped outer perimeter and a plurality of connecting members coupled to the outer perimeter of the panel. In certain embodiments of the invention, each side panel in the pair of side panels comprises a generally trapezoidal-shaped outer perimeter and a plurality of connecting members coupled to the outer perimeter of the side panel.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
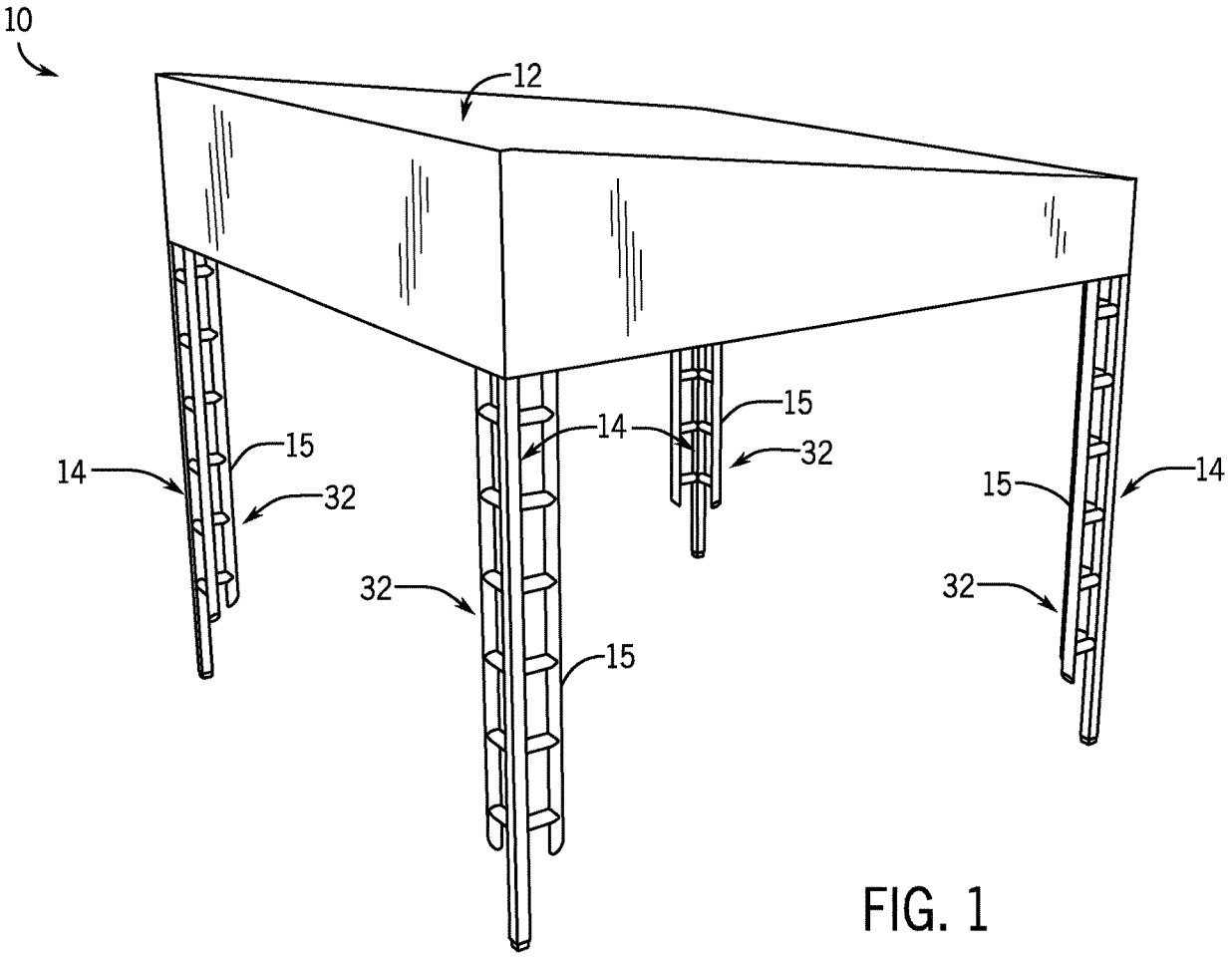
FIG. 1 depicts a perspective view of certain embodiments of the tent.
Figure 2:
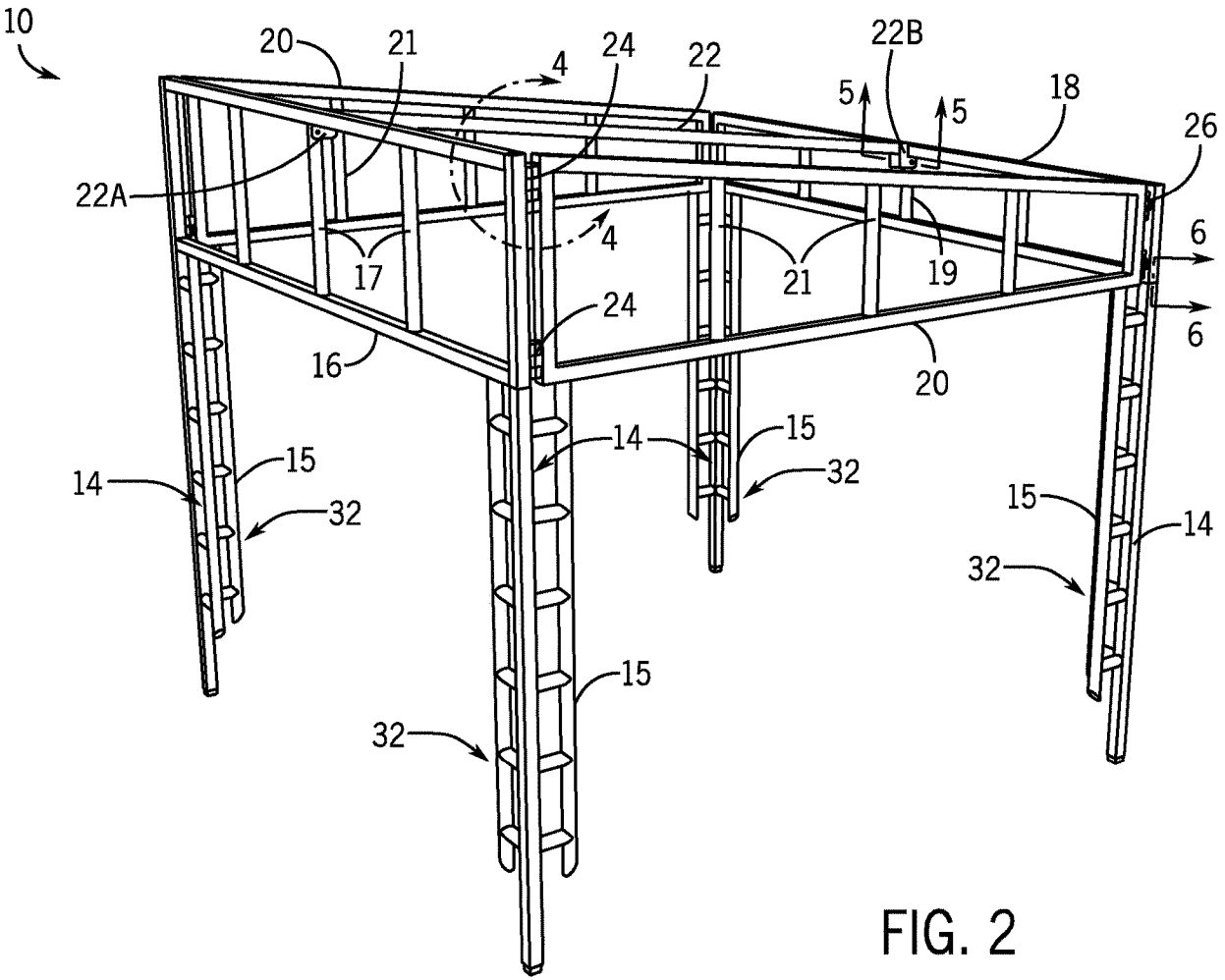
FIG. 2 depicts a perspective view of certain embodiments of the tent.
Figure 3:
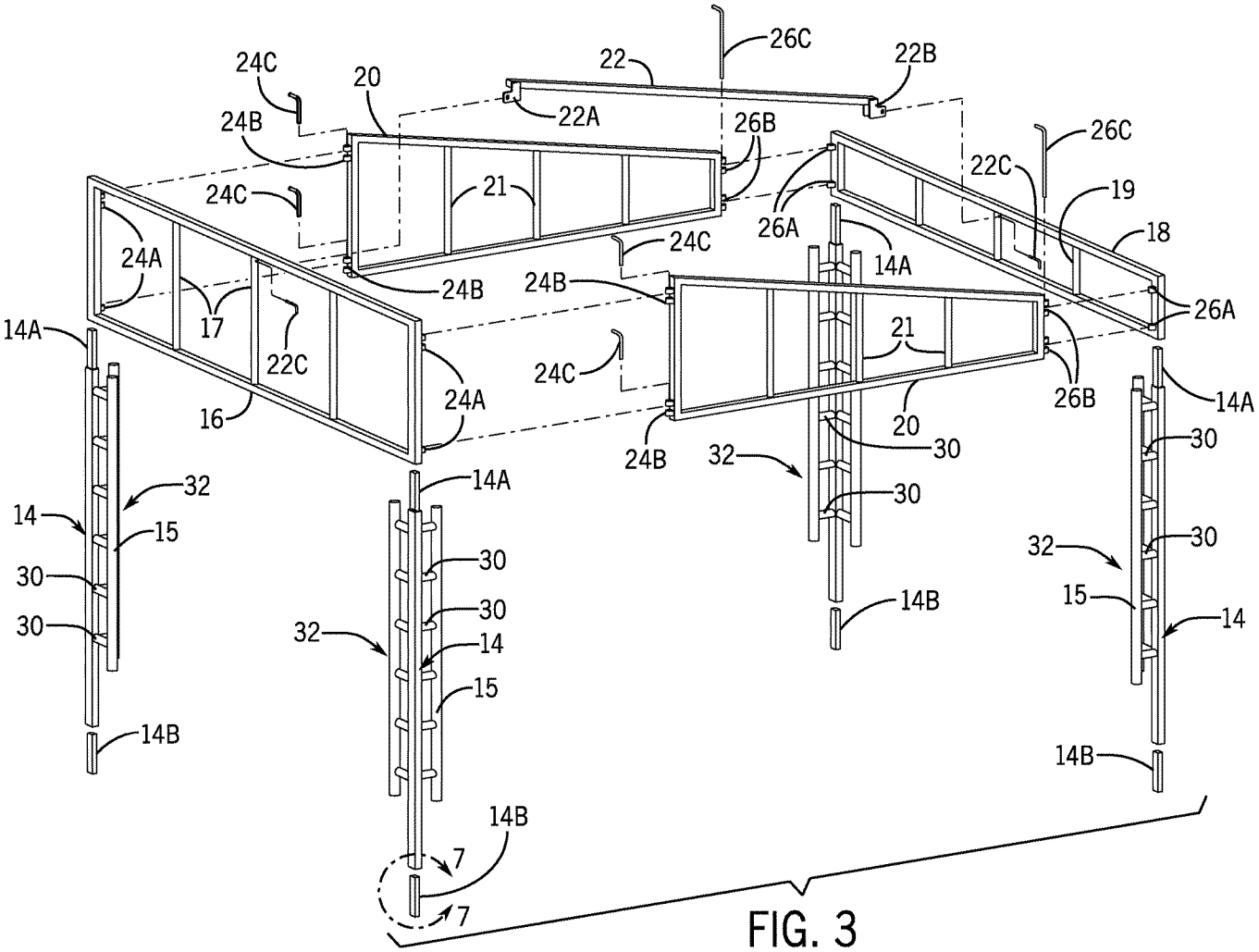
FIG. 3 depicts an exploded view of certain embodiments of the tent.

As depicted in FIGS. 1-3, tent 10 is configured to be assembled on a ground surface and support a plurality of bulky accessories and/or equipment such as those commonly used in the entertainment industry including, but not limited to, visual signs, lights, video screens, speakers, other sound accessories, and other forms of equipment used for advertising and hospitality purposes. Tent 10 generally comprises canopy 12, an upper panel assembly comprising front panel 16, rear panel 18 and side panels 20, and support legs 32. Front panel 16, rear panel 18, side panels 20 and support legs 32 are preferably made from aluminum tubing or piping. However, alternative materials or combination of materials may be used and be effective in supporting the accessories and/or equipment.

Front panel 16 comprises a generally rectangular-shaped outer perimeter and a plurality of vertical connecting members 17 coupled to the perimeter. In one embodiment, the outer perimeter of front panel 16 is made from approximately 2"×2"×0.125" tubes welded together. Each connecting member 17 is made from an approximately 2"×0.125" circular tube welded to the perimeter of front panel 16. Front panel 16 has approximate outer dimensions of 120"×30". However, the dimensions of front panel 16 may vary. Front panel 16 comprises primary front hinge members 24A coupled to corners of the rectangular-shaped perimeter.

Rear panel 18 comprises a generally rectangular-shaped outer perimeter and a plurality of vertical connecting members 19 coupled to the perimeter. In one embodiment, the outer perimeter of rear panel 18 is made from approximately 2"×2"×0.125" tubes welded together. Each connecting member 19 is made from an approximately 2"×0.125" circular tube welded to the perimeter of rear panel 18. Rear panel 18 has approximate outer dimensions of 120"×16". However, the dimensions of rear panel 18 may vary. Rear panel 18 comprises primary rear hinge members 26A coupled to corners of the rectangular-shaped perimeter.

Front and rear panels 16, 18 are coupled together by a pair of side panels 20. Each side panel 20 comprises a generally trapezoidal-shaped outer perimeter and a plurality of vertical connecting members 21 coupled to the perimeter of the side panel. In one embodiment, the outer perimeter of side panel 20 is made from approximately 2"×2"×0.125" tubes welded together. Each connecting member 21 is made from an approximately 2"×0.125" circular tube welded to the perimeter of side panel 20. In one embodiment, side panel 20 comprises approximate outer dimensions of a 16 7/16" rear height, 112 1/8" bottom length, 29 3/4" front height, and 112 15/16" top slanted length. However, the dimensions of side panel 20 may vary. Each side panel 20 comprises a pair of secondary front hinge members 24B and a pair of secondary rear hinge members 26B.

Figure 4:
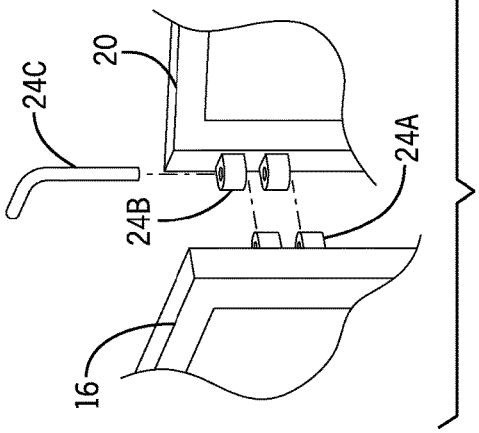
FIG. 4 depicts a perspective view of certain embodiments of the tent taken along line 4-4 in FIG. 2.

As depicted in FIGS. 2-4, each side panel 20 is maneuvered to align primary front hinge members 24A of front panel 16 with secondary front hinge members 24B of side panel 20. Once aligned, front hinge pin 24C is inserted through each corresponding pair of primary and secondary front hinge members 24A, 24B. Four front hinge pins 24C are required to secure the four corners of front panel 16 to the pair of side panels 20. In one embodiment, each front hinge pin 24C is approximately 5"×5/8".

Similarly, each side panel 20 is maneuvered to align primary rear hinge members 26A of rear panel 18 with secondary rear hinge members 26B of side panel 20. Once aligned, rear hinge pin 26C is inserted through corresponding primary and secondary rear hinge members 26A, 26B on each side of rear panel 18. Since the height of rear panel 18 is less than the height of front panel 16, only two rear hinge pins 26C are required to secure the four corners of rear panel 18 to the pair of side panels 20. In one embodiment, each rear hinge pin 26C is approximately 16"×5/8".

Figure 5:
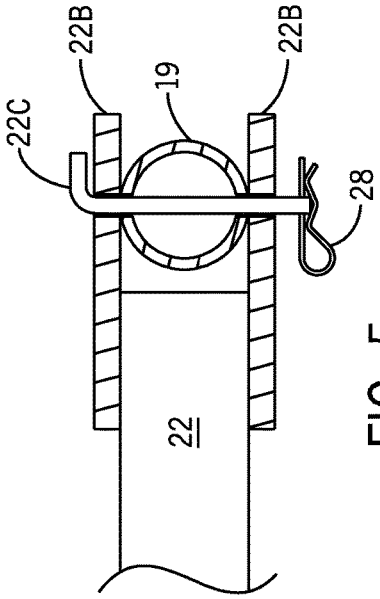
FIG. 5 depicts a section view of certain embodiments of the tent taken along line 5-5 in FIG. 2.

Purlin 22 is coupled to both front panel 16 and rear panel 18 and is configured to provide additional support to tent 10. More specifically, purlin 22 comprises a first end with front bracket 22A and a second end with a pair of rear brackets 22B. As depicted in FIGS. 2-3 and 5, the pair of rear brackets 22B is disposed around a central vertical connecting member 19 of rear panel 18 and secured in place by pin 22C and cotter pin 28. Front bracket 22A is coupled to a central vertical connecting member 17 by pin 22C and cotter pin 28. In one embodiment, pin 22C is approximately 5"×5/8". In an alternative embodiment, purlin 22 comprises a pair of front brackets 22A coupled to the central vertical connecting member 17 by pin 22C and cotter pin 28.

Figure 6:
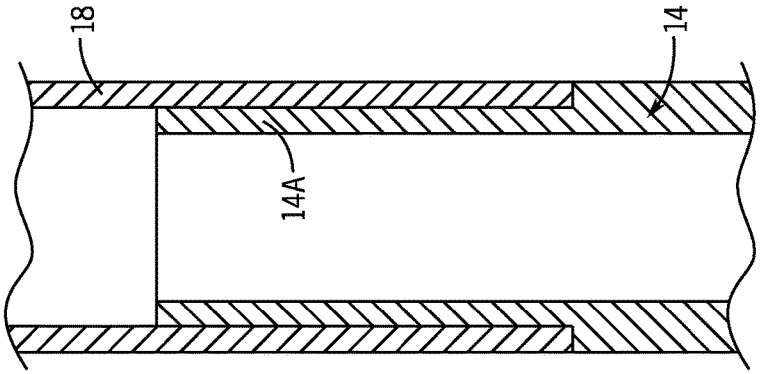
FIG. 6 depicts a section view of certain embodiments of the tent taken along line 6-6 in FIG. 2.

Four support legs 32 are coupled to the corners of the upper panel assembly. Each support leg 32 comprises main leg 14, upper extension 14A, foot 14B, accessory mounting tubes 15 and connecting rungs 30. As depicted in FIGS. 2-3 and 6, upper extension 14A of each support leg 32 is coupled to front panel 16 or rear panel 18. As depicted in FIG. 6, upper extension 14A of main leg 14 is inserted within an opening in rear panel 18. The remaining support legs 32 are secured to front panel 16 or rear panel 18 in the same manner. In an alternative embodiment, a mechanical fastener such as a bolt (not shown) is inserted through front or rear panels 16, 18 and each main leg 14 to better secure support leg 32 to the upper panel assembly. This enhances the stability of tent 10, especially when assembled in the presence of inclement weather where heavy winds are present.

In one embodiment, main leg 14 is approximately 2"×2"×0.125" tubing with a length of approximately 84". Upper extension 14A extends out of main leg 14 approximately 8" in length. A pair of accessory mounting tubes 15 are coupled to main leg 14 of each support leg 32 by a plurality of connecting rungs 30. Each accessory mounting tube 15 comprises a circular cross-section that is approximately 2"×0.125" with a length of approximately 72". However, the dimensions of accessory mounting tubes 15 may vary.

Figure 7:
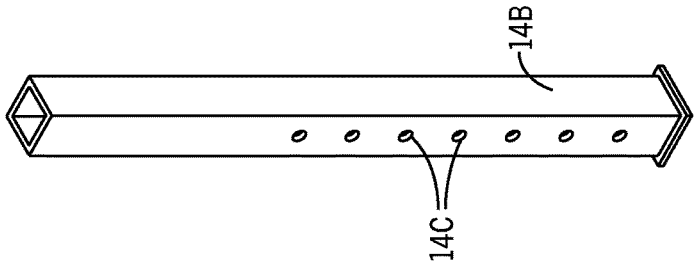
FIG. 7 depicts a perspective view of certain embodiments of the tent taken along line 7-7 in FIG. 3.

As depicted in FIGS. 3 and 7, foot 14B is inserted within the bottom of main leg 14 of each support leg 32. Foot 14B is a tubular member comprising a plurality of adjustment holes 14C configured to align with corresponding holes (not shown) in the bottom of main leg 14. Foot 14B can slidably adjust relative to main leg 14 to lengthen or shorten the overall length of support leg 32. Once the desired position is achieved, a locking component such as a pin is inserted through any hole in main leg 14 and a corresponding adjustment hole 14C in foot 14B. In one embodiment, each support leg 32 can extend up to at least 12" by adjusting foot 14B. This permits a user to adjust the overall height of tent 10 above the ground.

In operation, tent 10 is assembled and disposed on the ground. In one embodiment, canopy 12 is disposed around the sloping roof formed by front panel 16, rear panel 18 and side panels 20. Canopy 12 may be formed by any material such as vinyl and any number of sheets coupled together by fasteners such as hook and loop fasteners, zippers, snap components, and the like. Any accessories or equipment including, but not limited to, speakers, video displays, lights, other decorations and equipment, are coupled to support legs 32, front panel 16, rear panel 18 and side panels 20 as desired. Fasteners including adhesives, staples, clamps or other mounting devices may be used to secure the accessories and/or equipment to tent 10. In one embodiment, the horizontal spans of tent 10 are configured to support at least 300 lbs of equipment and/or accessories thereon.

It shall be appreciated that the components of tent 10 described in several embodiments herein may comprise any alternative known materials in the field and be of any color, size and/or dimensions. It shall be appreciated that the components of tent 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A tent with an enhanced load-bearing capacity for use on a ground surface, the tent configured to reduce assembly time and secure a plurality of accessories and equipment thereon, the tent comprising:

an upper panel assembly comprising a front panel, a rear panel and a pair of side panels connecting the front and rear panels together, the front, rear and side panels forming a roof with an upper sloping surface from the front panel to the rear panel, each panel in the front and rear panels comprising a generally rectangular-shaped outer perimeter and a plurality of connecting members coupled to the outer perimeter of the panel, each side panel in the pair of side panels comprising a generally trapezoidal-shaped outer perimeter and a plurality of connecting members coupled to the outer perimeter of the side panel;

a purlin comprising a first end coupled to one of the plurality of connecting members in the front panel and a second end coupled to one of the plurality of connecting members in the rear panel, each end in the first and second ends of the purlin comprising at least one bracket plate coupled thereto, the at least one bracket plate coupled to the one of the plurality of connecting members in the front panel or rear panel by a mechanical fastener; and a plurality of support legs coupled to the upper panel assembly, each support leg in the plurality of support legs comprising an upper end coupled to the upper panel assembly and a lower end in contact with the ground surface, each support leg in the plurality of support legs configured to slidably adjust to vary a length of the support leg to permit height adjustments of the roof above the ground surface;

wherein each support leg in the plurality of support legs and each panel in the upper panel assembly are configured to permit the attachment of one or more accessories or equipment thereon.

2. The tent of claim 1, further comprising a plurality of primary front hinge members coupled to the front panel, a plurality of primary rear hinge members coupled to the rear panel, a pair of secondary front hinge members coupled to each side panel in the pair of side panels, and a pair of secondary rear hinge members coupled to each side panel in the pair of side panels, wherein the pair of secondary front hinge members of each side panel are aligned with a corresponding pair of primary front hinge members in the plurality of primary front hinge members in the front panel and coupled together by at least one pin, wherein the pair of secondary rear hinge members of each side panel are aligned with a corresponding pair of primary rear hinge members in the plurality of primary rear hinge members in the rear panel and coupled together by at least one pin.

3. The tent of claim 2, further comprising a canopy disposed around the upper panel assembly.

4. The tent of claim 3, wherein each support leg in the plurality of support legs comprises a main leg coupled to the upper panel assembly and a pair of accessory mounting tubes coupled to the main leg by a plurality of connecting rungs.

5. The tent of claim 4, wherein each support leg in the plurality of support legs comprises a foot coupled to the main leg and in contact with the ground surface, the foot configured to slidably adjust relative to the main leg in one of a plurality of locking positions to vary the length of the support leg.

6. The tent of claim 5, wherein the main leg in each support leg of the plurality of support legs comprises an upper extension member inserted within a portion of the front panel or rear panel in the upper panel assembly.

7. The tent of claim 6, further comprising a mechanical fastener coupled to the main leg of each support leg in the plurality of support legs and the front panel or rear panel in the upper panel assembly.

* * * * *